US005107762A

United States Patent [19]

Fadner et al.

[11] Patent Number: 5,107,762

[45] Date of Patent: Apr. 28, 1992

[54] INKED DAMPENER FOR LITHOGRAPHIC PRINTING

[75] Inventors: Thomas A. Fadner, La Grange; Eugene M. Van Kanegan, Elmhurst, both of Ill.

[73] Assignee: Rockwell International Corporation, El Segundo, Calif.

[21] Appl. No.: 431,276

[22] Filed: Nov. 3, 1989

Related U.S. Application Data

[63] Continuation of Ser. No. 207,479, Jun. 16, 1988, abandoned.

[51] Int. Cl.[5] ..... B41F 31/06; B41F 7/26; B41F 7/30

[52] U.S. Cl. ..... 101/148; 101/451

[58] Field of Search ..... 101/148, 147, 350, 349, 101/363, 141, 450.1, 451, 452, 207-210

[56] References Cited

U.S. PATENT DOCUMENTS

| | | | |
|---|---|---|---|
| 2,960,929 | 11/1960 | Erzinger | 101/147 |
| 3,890,898 | 6/1975 | Fischer | 101/148 |
| 4,044,674 | 8/1977 | Smith, Jr. | 101/148 |
| 4,287,827 | 9/1981 | Warner | 101/141 |
| 4,567,827 | 2/1986 | Fadner | 101/350 |
| 4,690,055 | 9/1987 | Fadner et al. | 101/148 |

FOREIGN PATENT DOCUMENTS

| | | | |
|---|---|---|---|
| 203342 | 12/1986 | European Pat. Off. | 101/148 |
| 179778 | 8/1986 | Japan | 101/148 |

*Primary Examiner*—J. Reed Fisher

*Attorney, Agent, or Firm*—C. B. Patti; V. L. Sewell; H. F. Hamann

[57] ABSTRACT

A dampening system for a lithographic printing press is provided in which the source of water is separate from the dampener rollers and all the dampener rollers have surfaces that possess both oleophilic and hydrophobic properties.

20 Claims, 2 Drawing Sheets

INKED DAMPENER FOR LITHOGRAPHIC PRINTING

This is a continuation of Ser. No. 207,479, filed Jun. 16, 1988, now abandoned.

A lithographic printing process dampening system is described that utilizes dampening water input elements physically separated from a set of two or more oleophilic and hydrophobic dampener rollers, one of which is a form roller contacting the printing plate, which dampener set of rollers become and remain inked during printing operations.

BACKGROUND OF THE INVENTION

In the art and practice of continuous lithographic printing, it is essential to continuously supply, in addition to the printing ink, an aqueous dampening solution to the printing plate or plates. The dampening solution forms a water layer in all of the non-image areas of the printing plate thereby disallowing transfer of ink from a separate ink input system of rollers to all but the intended image areas of the printing plate.

The dampening water in lithography is commonly supplied to the printing plate in the form of a dilute aqueous solution containing various proprietary combinations of buffering salts, gums, wetting agents, alcohols, fungicides and the like, which additives function to assist in the practical and efficient utilization of the various water supply and dampening system combinations that are available for the practice of lithographic printing. Despite their very low concentrations, typically less than about several percent, the salts and wetting agents have in practice been found essential if the printing press system is to produce printed copies having clean, tint-free background and sharp, clear images, without having to pay undue and impractical amounts of attention to inking and dampening system controls during operations of the press.

In the practice of lithographic printing, different proprietary formulations of dampening solutions are found to be of greatest utility depending largely upon the configuration of the dampening system. There is need for a dampening system that significantly reduces the apparent dependence of dampening efficiency upon the particular materials in the dampening solution.

A convenient way to describe all dampening systems, although this two-portion description is not often used in the trade, is to consider the two necessary operations portions:

a. The water input portion consisting usually of a chromium or cloth-covered pickup roller, or spiral-brush spray system, or spray nozzles and the like, as well as the tubes, tanks and controllers, which together convert an at rest bulk liquid dampening solution into a more or less continuous directionally-oriented, relatively thin film or fine mist of the solution, and b. The dampener portion consisting of a series of one or more rollers that receive and then convey the thin film or fine mist of water from the water input portion to a printing plate that is rotating at printing press speeds.

Dampening systems may also be classified according to whether the water being supplied at the printing plate cylinder of the press is supplied before or after the ink is supplied.

It is repeatedly claimed that water-first dampening is better for optimal printing quality that water-last dampening. In fact, most prior art dampening systems, when used in the water-last position cannot maintain the image differentiation at the printing plate that is essential to lithographic printing. The practical reason for these observations is that the film of water transferred to the plate by a water-last dampener is applied after the ink has been refreshed to the plate image areas. This water film may interfere with subsequent transfer of ink from the printing plate to the printing blanket and thence to the paper being printed, producing printed copies of inferior quality and in the extreme disallowing any ink transfer to the printing portions of the press. Another reason for selecting water first dampening is that water-last dampening systems tend to cause stagnation and water-logging of the ink that always resides on the rubber dampening form roller. This can result in ink-slinging or even set-off of ink onto the printing plate in non-image areas resulting in unwanted printed marks. The present invention addresses and eliminates these heretofore accepted restrictions of dampener location to water-first.

SUMMARY OF THE INVENTION

A principal object of this invention is to provide a lithographic dampening system that results in high printed copy quality independently of configuration sequence of the ink input and water input at the printing plate.

Another objective is to provide a dampening system that functions at the minimum possible water input rate consistent with that required to retain image differentiation at the printing plate.

A further object is to minimize the number and frequency of ink and water balance related problems during lithographic printing.

Yet another object is to provide a dampening system utilizing an ink-biased series of distribution rollers which does not require high levels of surface active additives to assure efficient, high-quality lithographic printing operation.

These and other objects and features will become apparent by reference to the following specification and drawings in which.

Figure 1:
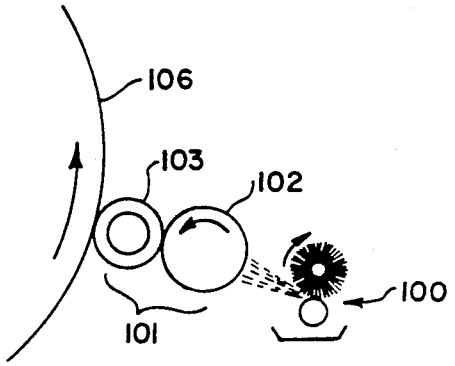
FIG. 1 is a schematic side elevation showing a dampening system as applied to a press plate roll.
Figure 2:
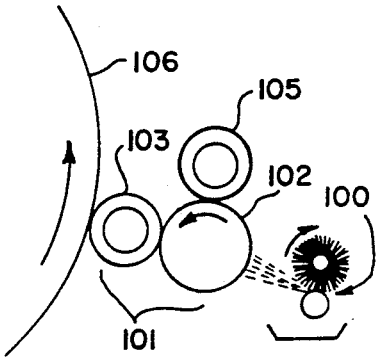
FIG. 2 is a modified dampening system of the type shown in FIG. 1.
Figure 3:
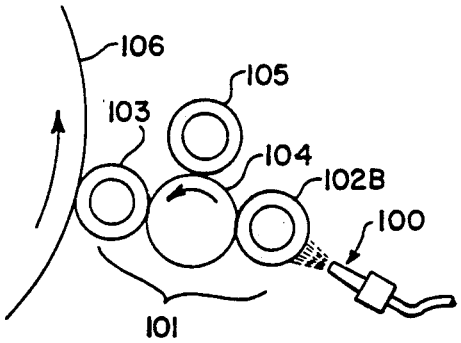
FIG. 3 is a further modified dampening system similar to those of FIGS. 1 and 2.

With reference to FIGS. 1, 2 and 3 the elements of our invention comprise an input dampening solution means 100 and a dampener set of rollers 101. The dampener set of rollers have oleophilic and hydrophobic surfaces and the set may consist of a receiving roller 102 or 102B, a dampening form roller 103, transfer roller 104 and one or more rider rollers 105. The oleophilic and hydrophobic surfaces help assure that all of the rollers in dampener set 101 are able to carry an ink film during printing operations despite the presence of large quantities of water. All of the roller surfaces of the dampener set are rotating substantially at press speed. Form rollers 103, rider rollers 105 and receiving roller 102B may be frictionally driven by physical interference with the surface of the plate cylinder 106 and/or with the separately driven receiving roller 102 or transfer roller 104. As mentioned above, it is required that all of the rolls used in the dampening system have surfaces that are oleophilic and hydrophobic. Rolls possessing both oleophilic and hydrophobic properties may be either metallic, such as copper, or non-metallic, such as rubber or plastic.

In the case of metallic or polymeric rubber or plastic rollers, whether soft or hard, this oleophilic/hydrophobic behavior can be more or less predicted by measuring the degree to which droplets of ink oil and of dampening water will spontaneously spread out on the surface of the metal or polymer rubber or plastic. The sessile drop technique as described in standard surface chemistry textbooks is suitable for measuring this quality. Generally, oleophilic/hydrophobic roller materials will have an ink oil (Flint Oil Co.) contact angle of nearly 0° and a distilled water contact angle of about 90° or higher. These values serve to define an oleophilic/-hydrophobic material.

We have found, for instance, that the following rules are constructive in but not restrictive for selecting materials according to this principle:

| | |
|---|---|
| Best | Water contact angle 90° or higher.<br>Ink Oil contact angle 10° or lower and spreading. |
| Maybe | Water contact angle 80° or higher. |
| Acceptable | Ink Oil contact angle 10° or lower and spreading. |
| Probably Not | Water contact angle less than about 80°. |
| Acceptable | Ink Oil contact angle greater than 10° and/or non-spreading. |

Another related test is to place a thin film of ink on the material being tested, then place a droplet of dampening solution on the ink film. The longer it takes and the lesser extent to which the water solution displaces or debonds the ink, the greater is that material's oleophilic/hydrophobic property.

Materials that have this oleophilic/hydrophobic property will in practice in a lithographic printing press configuration accept, retain and maintain lithographic ink on their surfaces in preference to water or dampening solution when both ink and water are presented to or forced onto that surface. It is this oleophilic/hydrophobic property that allows rollers used in lithographic press dampener roller trains of this invention to efficiently transport water from a water reservoir or water input system to the printing plate regardless of whether a water first or a water last configuration is used in the printing operation.

In the configurations illustrated in FIGS. 1 and 2, the oleophilic receiving roller surface 102 may be a relatively hard, inelastic substance such as copper or a carbon filled Nylon polymer such as Rilsan or any other oleophilic and hydrophobic nominally non-yielding material. The transfer roller 102B surface of the FIG. 3 alternative is selected from among elastomeric rubber-like materials that are oleophilic and hydrophobic. Rollers 102 and 104 are driven substantially at press speed either by gearing the roller to the press drive or by electrically coupling the speed of a separate motor attached thereto to the press drive. Alternately, roller 102B may be friction-driven by surface interference contact with roller 104.

Form rollers 103 in the FIGS. 1, 2 and 3 alternatives may be elastomeric carbon-filled rubber dampener form rollers typical in the art and practice of lithographic dampening, which rollers are naturally oleophilic and hydrophobic. Rollers 103 are advantageously friction driven by interference contact with both the printing plate 106 and the relatively hard roller 102 or 104. Alternatively, these rollers may be press driven or separately driven.

Rider rollers 105 may also be friction-driven and should have surfaces made of an elastomeric rubber-like material that is oleophilic and hydrophobic.

Figure 4:
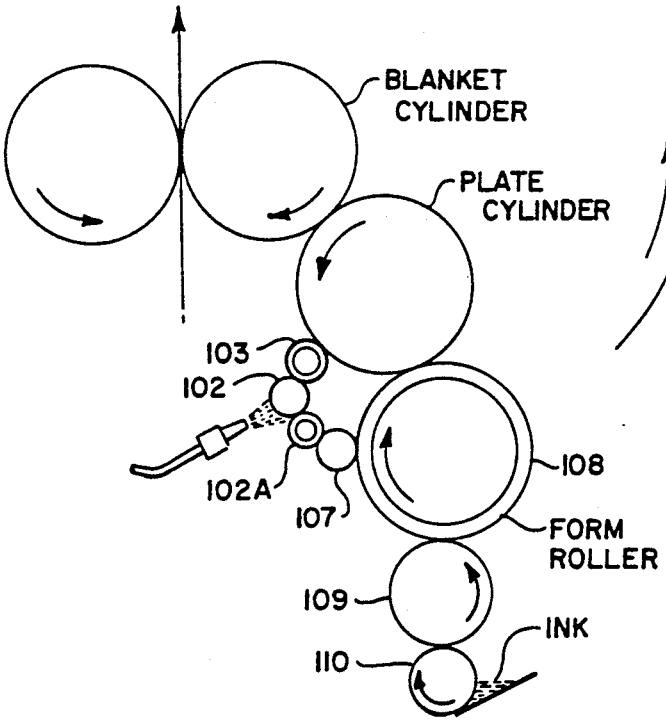
FIG. 4 is an alternative arrangement in which the dampening rolls are incorporated into the inking system.

FIG. 4 illustrates an alternative roller arrangement wherein the dampener form roller 103 is part of an inking system of oleophilic and hydrophobic rollers 102, 102A and 107 through 110. Other configurations can readily be visualized using the principles herein disclosed without departing substantially from the specified elements.

In agreement with prior experiences and art of lithography, we have found that the dampening system in FIG. 1 when used in the water-first configuration operates satisfactorily as a lithographic dampening system, even if a hydrophilic roller surface, such as chrome or nickel and the like would be substituted for our specified hydrophobic and oleophilic surfaced roller 102. However, when the FIG. 1 dampening system is fitted with a hydrophilic rather than an oleophilic and hydrophobic roller 102 and is used in the water-last position, we found that completely unacceptable results may be obtained in cross-press regions corresponding to low image content, the ink that always gradually builds-up on the rubber dampening form roller is more-or-less isolated between the water-covered hydrophilic predominantly non-image regions of the printing plate and the water-covered surface of the conventionally hydrophilic dampener roller. There exists no path for excess ink to be carried away from those regions of the dampener form roller. The isolated or stagnant ink picks up more and more water until it is so denatured that either it slings off the roller onto surrounding surfaces or it transfers off onto the plates thence to the paper, producing printed product of inferior quality.

In more severe instances, some of the water that is more or less uniformly delivered to all regions of the printing plate interferes with transfer of ink from the image areas of the printing plate to the printing blanket for transfer to the substrate being printed. We believe that the quantity of dampening water continuously required to maintain clean non-image areas on the printing plate using the FIG. 1 dampening system water-last is greater than the ink's ability to continuously and rapidly enough remove that portion of the input water unavoidably transferred to the surfaces of the printing plate image regions. That is, the thin ink film pressed by the form rollers onto the image areas of the plate generally cannot rapidly assimilate and thereby remove the interfering droplets or films or layers of dampening water from the surfaces of inked image areas of the plate. The result is a severe reduction in amount of ink transferred from the printing plate to the blanket and to the paper being printed. The interfering water layer remains on the image areas disallowing full transfer of ink to those image regions during the rotationally subsequent contact with the ink form rollers. The result is a build-up unused ink on the form rollers and a printed copy deficient in intended optical density or even devoid of portions of the intended image format.

When the configuration of FIG. 1 is used in the water-last position, but with oleophilic and hydrophobic rollers as specified in this disclosure, acceptable image differentiation is obtained, although the amount of operator attention required for balancing ink and water inputs remains significant. The result is printed quality nearly equivalent to water-first lithographic printing using the same dampening system. Of course, good quality is also obtained when the FIG. 1 alternative of this invention is used in the conventional water-first alternative.

This distinction between operable and not operable dampening is more dramatic when the water-first and water-last dampening positions are compared using the dampener of FIG. 1. Here, when the roller 102 surface is hydrophilic the printing system operates no better than that when the FIG. 1 dampening system is used with a hydrophilic roller. When roller 102 is oleophilic and hydrophobic as in this disclosure, excellent printing results are obtained using both dampener positions with relatively little operator attention required and a normal range of water input tolerance is present.

Further, when the dampening system of FIG. 3 is used with hydrophobic and oleophilic metering rollers, the prior art distinction in printing quality and in press stability between water-first and water-last dampening positions is lost. The use of inked dampening rollers allows superior printing despite water-last input of the dampening solution. This factor can be useful in the design of compact, efficient, convenient multiple printing station printing presses. Heretofore, dampening systems could safely be located only rotationally ahead of the inking input set of rollers if acceptable printed quality was to be obtained.

It is our belief that the multiple contact points at roller nips of the FIGS. 1, 2 and 3 configurations when specified according to this disclosure provide multiple sites for mulling or mixing the incoming dampening water into the films of ink on the dampener rollers and that it is primarily within these films of ink that water is actually conveyed to the printing plate. This means is in marked contrast with the widely held view used to design prior art dampening systems, namely, that the function of the dampening system components is to form a sufficiently thin film of water on a hydrophilic receiving or transfer roller that the water film will be able to transfer within the millisec dwell time in a single nip formed by the inked form roller and the hydrophobic roller carrying that film of water.

In the present invention, we provide multiple inked rollers and we provide ink films on all of the water-carrying rollers of the dampener so that for instance the two-inked-roller dampener of FIG. 1 has two opportunities to mull the water into the ink films, this number being greater than any of the prior art dampening systems which typically have one or none. The three-inked-roller dampening system of FIG. 2 is accordingly better than the prior art and the four-inked-roller dampening system of FIG. 3 is so much better than the prior art systems that it dispels the prevalent trade myth concerning water-first verses water-last dampening.

Figure 5:
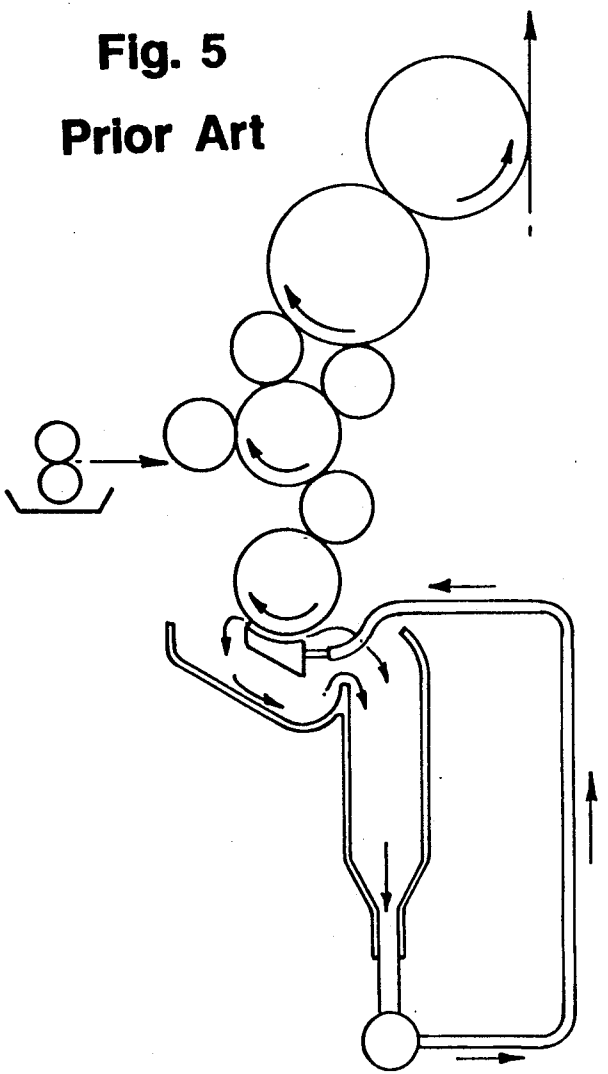
Fig. 5 Prior Art
FIG. 5 is an illustration of an ink train dampening printing system useful in comparing to this invention.

A set of illustrative printing tests was undertaken using the ink-train dampening system of FIG. 5 which has spiral brush water input to a keyless lithographic printing couple. This configuration approximates FIG. 4 dampening in that several of the inking rollers are also used as dampener rollers to convey water to the printing plate. In a keyless printing press the ink input is uniform across the press width and controlled by a celled metering roller and coacting doctor blade substantially as disclosed in U.S. Pat. No. 4,690,055. Keylessness is incidental to this example and a brief description is included here for sake of completeness of disclosure. A black keyless ink formulation manufactured by J. M. Huber Ink Co. of N.J., and Dampening Solution 800 at 1½ ounces per gallon of deionized water from C and W Unlimited, Carlstadt, N.J. were used. The dampening solution input was adjusted as low as possible and yet retain complete differentiation of image and non-image areas at the printing plate to thereby obtain good printed copy quality. During 60,000 copy print tests the dampening solution use was measured and under these conditions 0.25 ml to 0.29 ml of dampening solution per printed copy was required.

Figure 6:
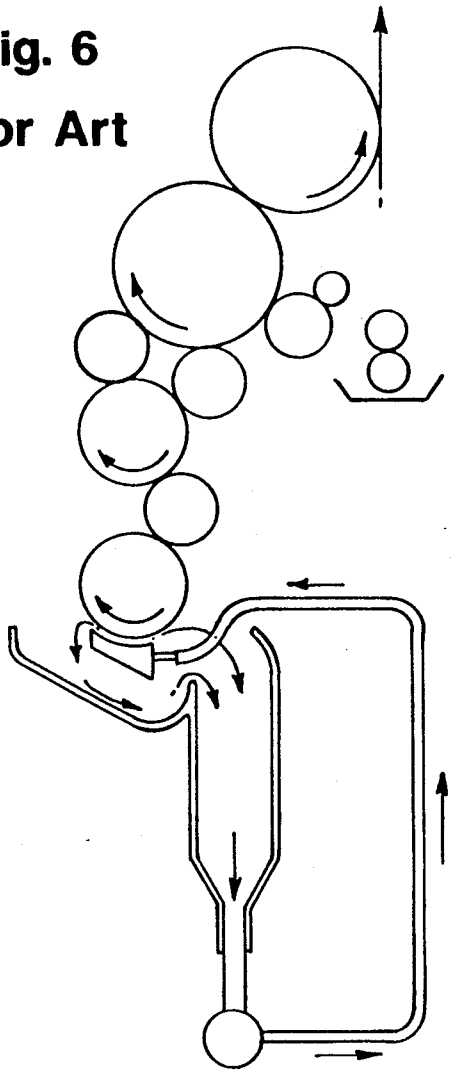
Fig. 6 Prior Art
FIG. 6 illustrates a conventional dampening system that the means and method of the present invention replaces.

The same materials, press components and conditions as in the preceding example, were used in separate tests except the spiral brush water input portion was placed together with a state-of-the-art dampener roller portion in the direct-to-plate water-first configuration substantially as depicted in FIG. 6. The dampening solution input requirement was considerably greater, 0.33 ml to 0.37 ml per copy.

It was apparent that the inked set of rollers in the first example delivered water more efficiently to the printing plate; that is, in a form or in such a manner that it was more directly usable by the printing plate that did the more conventional direct-to-plate hydrophilic roller dampening system.

Accordingly, the direct dampener of our invention specifically and advantageously uses a set of dampener rollers fully capable of accepting ink in presence of both ink and water; that is, having oleophilic and hydrophobic surfaces. And, also accordingly, we utilize inked dampener rollers to carry water to the printing plate in our invention and purposefully avoid any hydrophilic rollers in the dampener roller portion. Obviously, one can advantageously use one or more hydrophilic rollers in the water input portion of our invention as in prior art water-input portions of lithographic dampening systems, as long as none is included in the dampener train.

The dampening systems herein disclosed significantly reduce the number and frequency of lithographic printing problems that are variously termed in the trade as ink-water balance problems. We believe that the primary reason for in-water balance problems in the prior art resides in the wide-spread expectation that the printing plate somehow accepts water and ink only in the non-image and image areas respectively of the plate when thin films of both are made available to the plate.

None of the prior art dampening systems take into account that the ink must very rapidly accept the excess water that is always deposited on the image areas of the plate during each revolution of press. To do so the water must be in a form much more conducive to diffusion into an ink film than a continuous film of water on a hydrophilic dampener roller would be. We believe that our dampener systems meet this diffusional criterion and that our systems actually introduce water to the printing plate as minute droplets temporarily entrapped or emulsified in the ink films and having dimensions comparable to that required for optimal printed quality. To avoid water interference with ink transfer it is generally accepted that the largest water droplet dimension should be less than the smallest ink film thickness encountered during print, namely, less than about one to five microns. One way to assure formation of small droplets of one insoluble material in another is to repeatedly mull the two materials together. Repeated mulling of water into ink at two or more inked dampener roller nips as specified herein accomplishes this criterion. Consequently, we anticipate that our invention allows broader water-input operating range for a given set of ink and dampening solution materials and press conditions. We also expect that a broader range of ink and dampening solution formulations will be operable than that encountered when using prior art dampening systems. Both of these advantageous features function to reduce the number and severity of printing problems associated with balancing the ink and water inputs for optimum printed quality.

Prior art hydrophilic-roller-based dampening systems that utilize one of the inking form rollers to convey water to the printing plate require from about 10% to 25% of a bulk surface active additive such as isopropanol to allow reasonably fast dampening water transfer from the hydrophilic metering roller to the inked form roller. The alcohol acts to assist the water-to-ink transfer process which, as previously discussed, cannot otherwise occur within the short single nip dwell times of this prior art system. Interestingly, hydrophilic-roller-containing dampening systems are reportedly easier to control, to have more latitude in ink-water balance, and to have fewer ink-water balance problems when 10% to 25% isopropanol is used in the dampening solution, that is, when the water is helped into the ink by means of the chemical additive.

The reason for this alcohol-assisted result is clearly related directly to the absence of sufficient water-into-ink mulling action in prior art dampening systems. And, accordingly, the dampening systems of this disclosure do not require a surface assistance alcohol additive. Mechanical mulling improves upon and replaces that additive's function. This is a significant improvement in view of the cost, health hazard and safety hazard associated with the use of isopropanol.

The advantageous features of inked roller ink-train dampening systems have been previously noted herein as reference and background for the present disclosure. It should be noted that ink train-dampening systems have certain, somewhat adverse qualities that are avoided by using the direct inked-roller dampening system of this disclosure.

When printing formats have cross-press locations that circumferentially have low percent image, very little ink is printed out onto the paper. Also, very little water is being printed out onto the paper because the major path for water getting to the paper is by means of the ink being printed out. Since dampening water input is more-or-less uniform across the press, the water content of the ink residing on the inking rollers in regions corresponding to low percent image may become higher than the inks ability to assimilate. This can result in sporadic debonding of ink from the inking rollers by appearance of free water layers causing localized build-up and slinging of ink onto various press components. By using direct inked dampening as herein disclosed, an additional path for water evaporation is provided, namely the inked dampener rollers. The increased surface area allows evaporation of a greater amount of this excess water in cross press regions corresponding to the differing water contents. This minimizes the adverse affect of water build-up due to image format differences.

More importantly, the dampening water of this invention enters the inking system only indirectly as compared to direct introduction of water into the inking train. Only the water already supplied to the plate and then fractionally removed by inking form rollers can enter the inking system. Water content within the incoming ink on the dampener set of rollers is thereby expected to be considerably lower than that encountered in ink-train-dampening. Accordingly, fewer problems in adjusting for ink and water input balance will be encountered.

When no ink is being printed out at specific cross-press locations, it is common practice to use physical barriers or water stops or wipes that allow only small amounts of dampening water to reach the plate at those locations, that is, only enough water is allowed to keep those non-image areas of the plate free of ink. To accommodate low ink coverage regions where use of water stops is too severe, another typical practice is to oscillate one or more of the dampening rollers and thereby laterally distribute portions of the excess water. Accordingly, any or all of dampener set of rollers in FIGS. 1, 2, 3 and 4 may advantageously be caused to oscillate axially for similar reasons.

In keyless lithographic printing presses a significant portion of the ink available to the printing plate must be scraped off and recirculated to the ink input portion of the inker. Since this serves to carry excess water away from the printing plate and redistribute it across the press width, water stops may generally not be required and oscillation as a cross-press water distribution means may become redundant.

We believe that the elements of our invention, taken together, operate upon startup of a printing press to which the dampening system described herein is attached by rapidly removing some of the ink from the printing plate image areas, or in FIG. 4 alternative from an inking form roller, to quickly establish a thin film of ink on all of the dampener rollers. Water being applied to the receiving roller as a mist or spray is mulled, mixed and emulsified into these ink films on the dampener rollers by the shearing conditions at each of the roller-to-roller nips of the dampener set. This establishes a continual refining of the initially large input drops or mist of water as it traverses the dampener rollers towards the plate, becoming micron and submicron sized droplets suspended in the ink by the time they reach the form roller and the plate. As such, their dimension is smaller than the ink film thickness at the printing plate, which small droplets can readily and rapidly transfer back and forth between inked and non-inked areas of the plate, thereby functioning to supply water to the non-image areas where it is required. The dampener of this invention thereby also disallows formation of free water films in the plate image areas that could interfere with subsequent transfer of ink either to the plate from the inking form rollers or from the plate to the printing blanket, thence to the substrate being printed.

What is claimed is:

1. In a lithographic printing system having a plate cylinder and inking apparatus for carrying ink from a reservoir to the plate cylinder, the improvement being a dampening system separate from the inking apparatus for carrying dampening liquid from a source to the plate cylinder, comprising:

a form roller having an oleophilic and hydrophobic surface in rolling contact with the plate cylinder; and means for conveying dampening liquid to the form roller from the source including a dampener roller in rolling contact with the form roller with an oleophilic and hydrophobic surface, said oleophilic and hydrophobic surface of the form roller receiving from said plate cylinder and retaining thereon a layer of ink which is emulsified together with said dampening liquid at least in part by the rolling action between the dampener roller and the form roller before being conveyed to the plate cylinder, and said oleophilic and hydrophobic surface of the dampener roller receiving from said form roller and retaining thereon a layer of ink which is emulsified together with said dampening liquid at least in part by the rolling action between the form roller and the dampener roller; and at least one other roller in rolling contact with the dampener roller and having an oleophilic and hydrophobic surface, said oleophilic and hydrophobic surface of the other roller receiving from said dampener roller and retaining thereon a layer of ink which is emulsified together with said dampening liquid at least in part by the rolling action between the dampener roller and the other roller.

2. The lithographic printing system of claim 1 in which said form roller is positioned in a water-first configuration around said plate cylinder relative to the inking apparatus.

3. The lithographic printing system of claim 2 in which said form roller is the only dampening liquid roller in rolling contact with the dampener roller.

4. The lithographic printing system of claim 1 in which the at least one other roller includes a rider roller in rolling contact with the dampener roller to additionally emulsify the dampening liquid into the ink layer carried by the dampener roller.

5. The lithographic printing system of claim 4 in which said dampener roller is a receiving roller for receiving dampening liquid directly from the source prior to emulsification with any ink from the plate cylinder.

6. The lithographic printing system of claim 1 in which said at least one other roller includes a receiving roller for conveying dampening liquid to the dampener roller in rolling contact therewith, said receiving roller having an oleophilic and hydrophobic surface for receiving from said dampener roller and retaining a layer of ink into which said dampening liquid is emulsified in part by rolling action between the dampener roller and the receiving roller.

7. The lithographic printing system of claim 6 in which said at least one other roller includes a rider roller in rolling contact with said dampener roller for further emulsifying together ink and dampening liquid carried by same dampener roller before being conveyed to the form roller.

8. The lithographic printing system of claim 1 in which said dampening liquid conveying means includes a train of rollers including said dampener roller for emulsifying dampening liquid into layers of ink picked up from the ink on the plate cylinder, all of said rollers of the train having oleophilic and hydrophobic surfaces.

9. The lithographic printing system of claim 1 in which said oleophilic and hydrophobic surface of the form roller has a water contact angle of at least eighty degrees and an ink oil contact angle not greater than ten degrees and spreading.

10. The lithographic printing systems of claim 9 in which said water contact angle is at least ninety degrees.

11. A method of conveying dampening liquid to a lithographic plate cylinder separate from the conveyance of ink thereto from an ink source, comprising the steps of:

conveying dampening the liquid from a source to the plate cylinder by means including at least three rollers having oleophilic and hydrophobic surfaces including a form roller in rolling contact with the plate cylinder;

conveying ink from the plate cylinder to the at least three rollers with oleophilic and hydrophobic surfaces;

rolling the dampening liquid into the ink at at least two nibs of rolling contact between the at least three rollers to create an emulsification of ink and dampening liquid on the form roller; and transferring the dampening liquid in said emulsification on the form roller to said plate cylinder via rolling contact between the oleophilic and hydrophobic form roller and the plate cylinder.

12. The method of claim 11 in which said step of conveying dampening liquid to the plate cylinder includes the step of receiving dampening liquid directly from the source onto a receiving one of said at least three rollers.

13. The method of claim 12 in which said step of emulsifying includes the step of emulsifying at a nib of roller contact between the receiving roller and the form roller.

14. The method of claim 12 in which said step of emulsifying includes the step of emulsifying at a nib of rolling contact between the form roller and another roller intermediate the form roller and the receiving roller.

15. The method of claim 11 in which said step of emulsifying includes the step of emulsifying ink and dampening fluid together at the nib between the form roller and another oleophilic and hydrophobic roller in rolling contact therewith.

16. The method of claim 15 in which said other oleophilic and hydrophobic roller is a receiving roller to which said dampening liquid is initially conveyed before being emulsified with ink.

17. The method of claim 15 in which said step of emulsifying includes the step of emulsifying at the nib of rolling contact between the other oleophilic and hydrophobic roller and a rider roller in rolling contact therewith.

18. The method of claim 14 in which said other roller is intermediate the form roller and a receiving roller for receiving dampening liquid from the source, and said step of emulsifying includes the step of emulsifying dampening liquid carried by the receiving roller with ink carried by the other intermediate roller at the nib of rolling contact thereby.

19. The method of claim 11 in which said step of emulsifying includes the step of emulsifying emulsions of ink and dampening liquid together at the nibs of roller contact between a plurality of oleophilic and hydrophobic rollers including the form roller.

20. The method of claim 11 in which said step of conveying dampening liquid from the source to the form roller includes the step of transferring an emulsion of dampening liquid and ink.

* * * * *